US010036605B1

(12) United States Patent
Kosman

(10) Patent No.: US 10,036,605 B1
(45) Date of Patent: Jul. 31, 2018

(54) ADJUSTABLE MUZZLE DEVICE

(71) Applicant: Kurt A. Kosman, Lee's Summit, MO (US)

(72) Inventor: Kurt A. Kosman, Lee's Summit, MO (US)

( * ) Notice: Subject to any disclaimer, the term of this patent is extended or adjusted under 35 U.S.C. 154(b) by 0 days.

(21) Appl. No.: 15/703,256

(22) Filed: Sep. 13, 2017

Related U.S. Application Data

(60) Provisional application No. 62/482,545, filed on Apr. 6, 2017.

(51) Int. Cl.
*F41A 21/00* (2006.01)
*F41A 21/38* (2006.01)

(52) U.S. Cl.
CPC ..... *F41A 21/38* (2013.01)

(58) Field of Classification Search
CPC ..... F41A 21/38; F41A 21/31; F41A 21/34; F41A 21/36
USPC ..... 89/14.3
See application file for complete search history.

(56) References Cited

U.S. PATENT DOCUMENTS 618,901 A * 2/1899 Peterson ..... F41A 21/40 42/79
2,191,484 A * 2/1940 Hughes ..... F41A 21/38 89/14.3
2,484,988 A 10/1949 Finlay
2,484,998 A * 10/1949 Hutchinson ..... F41A 21/40 42/79
2,589,738 A * 3/1952 Sedberry ..... F41A 21/42 42/79
2,600,874 A 6/1952 Hoza
2,712,193 A * 7/1955 Mathis ..... F41A 21/42 42/79
2,883,781 A * 4/1959 Harvey ..... F41A 21/34 42/105
2,989,815 A 6/1961 Hare
3,045,378 A 7/1962 Denaux
3,243,910 A * 4/1966 Weiser ..... F41A 21/42 42/79
3,698,747 A * 10/1972 Wing ..... F16L 37/144 285/305
4,374,484 A * 2/1983 Bekker ..... F41A 21/38 89/14.3
4,813,333 A * 3/1989 Garris ..... F41A 21/38 89/14.3
5,333,529 A * 8/1994 Brockman ..... F41A 21/38 42/79

(Continued)

FOREIGN PATENT DOCUMENTS

GB 233709 1/1926

*Primary Examiner* — Michelle R Clement
(74) *Attorney, Agent, or Firm* — Brinks Gilson & Lione

(57) ABSTRACT

Adjustable stabilizing attachments for a firearm and, more particularly, to adjustable stabilizing devices that may be attached to the muzzle end of the firearm to assist in reducing forces exerted during firing, such as lateral shift, vertical displacement, or longitudinal twisting as well as assisting in suppression of muzzle flash, reduction in recoil and/or firing noise and concomitant firing concussion are herein disclosed. The multi-position devices are useful for, inter alia, adapting a firearm's capabilities to meet the needs of firing situations presented to the user, without the need to switch to alternative devices.

17 Claims, 8 Drawing Sheets

(56) References Cited

U.S. PATENT DOCUMENTS 5,357,842 A * 10/1994 Reynolds ..... F41A 21/36 89/14.3
5,425,298 A * 6/1995 Coburn ..... F41A 21/38 89/14.3
5,631,438 A 5/1997 Martel
5,685,102 A 11/1997 Latka
5,698,810 A 12/1997 Rose
5,860,242 A 1/1999 O'Neil
6,079,311 A * 6/2000 O'Quinn ..... F41A 21/30 42/79
6,276,251 B1 8/2001 Downing et al.
6,425,310 B1 * 7/2002 Champion ..... F41A 21/30 89/14.3
6,557,290 B2 5/2003 Kumler
6,668,815 B1 * 12/2003 Fernandez ..... F41A 11/00 124/83
7,059,235 B2 * 6/2006 Hanslick ..... F41A 21/38 89/14.3
8,387,299 B1 * 3/2013 Brittingham ..... F41A 21/30 42/90
8,511,425 B2 * 8/2013 Larue ..... F41A 21/30 181/223
9,080,829 B1 * 7/2015 Cellini ..... F41A 21/36
9,182,187 B1 * 11/2015 Griffith ..... F41A 21/32
9,207,034 B2 * 12/2015 Larson, Jr. ..... F41A 21/36
9,310,152 B1 * 4/2016 Poling ..... F41A 21/36
9,377,263 B1 * 6/2016 Sy ..... F41A 21/36
9,441,901 B1 * 9/2016 Harrison ..... F41A 21/36
9,709,354 B2 * 7/2017 Larue ..... F41A 21/30
9,857,137 B2 * 1/2018 Barrett ..... F41A 21/28
2003/0154849 A1 * 8/2003 Breuer ..... F41A 21/36 89/14.3
2013/0047484 A1 2/2013 Wickser
2013/0180797 A1 * 7/2013 Dueck ..... F41A 21/30 181/223
2014/0020976 A1 * 1/2014 Shults ..... F41A 21/30 181/223
2014/0231168 A1 * 8/2014 Dueck ..... F41A 21/325 181/223
2014/0374189 A1 * 12/2014 Young ..... F41A 21/30 181/223
2015/0308774 A1 * 10/2015 Sherrill ..... F41A 21/34 89/14.2
2016/0091269 A1 * 3/2016 Miller, III ..... F41A 21/36 89/14.3
2016/0123689 A1 * 5/2016 Maeda ..... F41A 21/30 89/14.3
2016/0209153 A1 * 7/2016 Dueck ..... F41A 21/32
2017/0299316 A1 * 10/2017 Vossler ..... F41A 21/34
2018/0058791 A1 * 3/2018 Larue ..... F41A 21/325

* cited by examiner

ADJUSTABLE MUZZLE DEVICE

CROSS-REFERENCE TO RELATED APPLICATIONS

This application claims the benefit of U.S. Provisional Patent Application Ser. No. 62/482,545, filed Apr. 6, 2017, the entire contents of which is hereby incorporated herein by reference in its entirety.

FIELD OF THE INVENTION

The present invention relates generally to adjustable stabilizing attachments for a firearm and, more particularly, to adjustable stabilizing devices that may be attached to the muzzle end of the firearm to assist in reducing forces exerted during firing, such as lateral shift, vertical displacement, or longitudinal twisting. These devices may also assist in suppression of muzzle flash, reduction in recoil and/or firing noise and concomitant firing concussion.

BACKGROUND OF THE INVENTION

During normal operation of a firearm, when a round is fired, gas from the burning propellant forces the bullet through the barrel. As the bullet travels down and out of the barrel, the bullet and the propellant gases act on the barrel, along the longitudinal axis, or centerline, of the barrel, to produce a recoil force. Because of the difference between the longitudinal axis of the barrel and the average point of contact between the firearm and the user (the average point where the user resists the recoil force), the muzzle end of the firearm's barrel rotates upward. Such muzzle rise, or muzzle climb, is particularly evident for firearms having gripping features (e.g., a stock or grip) arranged such that a vertical distance (i.e., the moment arm) between the center line of the barrel and a center of contact with the shooter is particularly large. The muzzle riseor muzzle climb is not solely in an upward direction. For a right handed shooter, the muzzle rise or muzzle climb includes a vector somewhat to the right (from the shooter's perspective) of directly "up." Accordingly, after firing a shot, the shooter must move the muzzle downwardly and slightly to the left to realign with the target. Causes may include the ergonomics of how a firearm is typically held by a shooter, the effect of rifling, if present (which usually spins the projectile in a right handed direction), and the cycling of an auto-loading action (including rotation and reciprocation of the bolt and ejection of a spent ammunition casing).

In addition to forces exerted during firing, such as recoil, lateral shift, vertical displacement, or longitudinal twisting, other consequences of firing a firearm, including muzzle flash, firing noise and concomitant firing concussion, have been the target of efforts to reduce or minimize these consequences' impacts on the shooter in various scenarios. Generally speaking, these prior art devices are good at carrying out only a singular function for the shooter (noise/concussive force redirection, flash suppression, or recoil reduction/shooting accuracy). A shooter will typically attach one of these devices to the firearm as dictated by the particular situation presented to the shooter. If the situation changes, the previously attached device needs to be removed and replaced with an alternative device designed to carry out the function of highest importance to the shooter that is required by the changing situation.

When a round is fired, the noise level and associated concussive force can be quite high and large, respectively.

Certain linear compensators have been developed to direct most of the noise and/or concussive forces forward of the shooter as a means of reducing their overall impacts. However, linear compensators generally do not reduce recoil forces or appreciably reduce the amount of muzzle flash associated with the firing.

Muzzle flash can be an issue for the shooter in tactical situations where a shooter wishes to keep his exact location away from opponents, especially at night. Flash suppressors are devices which are attached to the muzzle of a firearm and are designed to reduce the visible signature of expanding gases visible to the shooter. These gases, visible as a flash, are distracting to the shooter and may be temporarily blinding in low-light conditions. Additionally, night vision devices of the type now commonly used by the military may be rendered temporarily inoperable as a result of the short-term saturation of the light sensor mechanism in such night vision devices.

Muzzle flash is typically addressed at least in part through the use of flash suppressors. Generally speaking, prior art flash suppressors are designed with a series of vent channels that allow propellant gases to exit the barrel of the firearm in a controlled fashion and over a large surface area, thereby dissipating the flash which would otherwise be present from concentrated gases exiting the muzzle end of a barrel behind the projectile at firing. These vent channels, likewise, generally vent propellant gases in a direction that is approximately perpendicular to the longitudinal axis of a firearm barrel.

In situations where reduction of shooter impacts caused by recoil or other forces exerted during firing, such as lateral shift, vertical displacement, or longitudinal twisting is important, muzzle brakes tend to be employed. Reduction of these impacts becomes tantamount whenever high levels of shooting accuracy are needed, such as in target competitions. In these situations, the recoil from firing a round is often a hindrance to the shooter, no matter how small. A muzzle brake works to counteract this force and reduce recoil and muzzle rise by redirecting gas from the cartridge.

Firearm muzzle brakes are devices typically attached to or integral with the barrel of a firearm, generally at the barrel's muzzle, which are designed so as to redirect the muzzle blast in order to reduce or control the effect of the recoil and/or lessen unwanted movement of the barrel by helping to stabilize the muzzle while firing. They usually do this in one or both of these ways. First, a muzzle brake may present a surface against which the propellant gases impact, causing that transferred force to pull the barrel forward, counteracting part of the recoil forces. Second, redirection of propellant gases laterally, or even somewhat rearwardly, reduce or neutralize the recoil effects of the muzzle blast. If uncorrected, these recoil effects may cause inaccuracies in the targeting of the firearm. Such muzzle brakes are generally constructed so as to provide for an alternative exit of propellant gases, usually in the form of one or more slots, vents, holes, channels and/or baffles positioned at some angle to the bore of the barrel, to compensate for the tendency of the muzzle to move upward when firing. These holes or channels are designed to exhaust propellant gases in a direction that is generally perpendicular to the longitudinal axis of a firearm barrel.

In other cases, a muzzle attachment or porting that is provided along the top of the barrel or that is otherwise upwardly directed, used in combination with minimal or absent redirection or porting that is downwardly directed, exerts a downward force on the muzzle endof the barrel that at least partially counteracts the muzzle rise or muzzle climb described above.

Additionally, the effective diameter of commercially available muzzle brakes, suppressors, or compensators, is generally much larger than the diameter of the projectile that is propelled through it, resulting in an inefficient performance of these devices. What is greatly needed is a muzzle brake and flash suppressor which is effective at reducing experienced recoil, and stabilizing the muzzle. Such a device would ideally have an effective inner diameter as close to the diameter of the projectile being discharged through it in order to provide for maximum effectiveness of the device. Many other benefits, objects and the like will be evident to those of skill in the art once armed with the disclosures of the present invention.

Such muzzle devices, whether a muzzle brake, flash suppressor, or compensator, include outlet ports that are asymmetric from top to bottom, about an imaginary horizontal plane. That is, porting is minimized or absent along the bottom of the device and is maximized toward the top and/or sides of the device. The porting in such devices, however, is symmetrical left to right, about an imaginary vertical plane.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

Linear compensators, flash suppressors and muzzle brakes are used in the art to give the user a tactical advantage or to reduce adverse environmental conditions. These prior art devices may perform reasonably well in addressing a single need, but still fail to address numerous other issues surrounding firearm use. There is not a device known in the prior art which satisfactorily allows a shooter to select the most appropriate device for his firearm in changing conditions without having to remove one type of muzzle device from the firearm in favor of another. Nor is there any single muzzle device integral to a firearm barrel that is capable of providing all of the functions of a linear compensator, flash suppressor and muzzle brake. A need exists for improved firearm devices designed to assist a user in stabilizing a firearm during its firing operation and/or adapting the firearm to changing conditions without having the physically exchange one device for another. Consequently, there is a need in the art for an adjustable muzzle device capable of providing, alternatively, the performance of a linear compensator, muzzle brake or flash suppressor, preferably a device wherein any adjustments to the device's performance that would be useful or necessary to accommodate changing conditions may be made, preferably readily and simply, while the device remains attached to the firearm. The present invention is directed to these and other important ends.

BRIEF SUMMARY OF THE INVENTION

One or more of the preceding drawbacks of currently available muzzle devices are improved, and an advance is made in the art by a novel adjustable muzzle device. According to one aspect of the present invention, adjustable muzzle devices are provided that reduce forces exerted during firing, such as lateral shift, vertical displacement, or longitudinal twisting.

According to another aspect of the present invention, adjustable muzzle devices are provided that suppress muzzle flash.

According to another aspect of the present invention, adjustable muzzle devices are provided that reduce recoil.

According to another aspect of the present invention, adjustable muzzle devices are provided that reduce firing noise and concomitant firing concussion.

According to another aspect of the present invention, adjustable muzzle devices are provided that assist in two or more of suppression of muzzle flash, reduction in recoil, and firing noise and concomitant firing concussion.

According to yet another aspect of the present invention, the adjustable muzzle devices reduce the visible signature of expanding gases visible to the shooter.

According to yet another aspect of the present invention, the adjustable muzzle devices reduce the potential for temporary blinding in low-light conditions due to firing flash.

According to another aspect of the present invention, the adjustable muzzle devices are attached to or integral with the distal portion of the barrel of a firearm, generally at the barrel's muzzle.

According to yet another aspect of the present invention, the adjustable muzzle devices are a muzzle brake and flash suppressor which is effective at reducing shooer-experienced recoil and stabilizing the muzzle.

According to yet another aspect of the present invention, the adjustable muzzle devices have an effective inner diameter only slightly larger than (preferably less than about 20, 15, 10, or even only about 5% larger the diameter of the projectile being discharged through it in order to provide for maximum effectiveness of the device.

According to another aspect of the present invention, the adjustable muzzle devices allow a shooter to select the most appropriate device for his firearm in changing conditions without having to remove one type of muzzle device from the firearm in favor of another.

According to yet another aspect of the present invention, the adjustable muzzle devices are designed to assist a user in stabilizing a firearm during its firing operation and/or adapting the firearm to changing conditions without having the physically exchange one device for another.

According to yet another aspect of the present invention, the adjustable muzzle devices are capable of providing, alternatively, the performance of a linear compensator, muzzle brake or flash suppressor, preferably a device wherein any adjustments to the device's performance that would be useful or necessary to accommodate changing conditions may be made, preferably readily and simply, while the device remains attached to the firearm.

According to a further aspect of the present invention, the adjustable muzzle devices comprise: a body having a distal end, a proximal end, and a central passageway extending therebetween, the body being mountable to the muzzle end of the firearm barrel such that the central axis is aligned with a barrel axis defined by a bore of the firearm barrel, said body further comprising a cylindrical side wall portion extending proximally from the distal end; and a first plurality of ports provided on the body and spaced circumferentially about the central axis, the first plurality of ports extending radially outward from a first point located along the central axis to the cylindrical side wall portion, open to the central passageway and to an ambient environment external to the body side wall, the plurality of ports in fluid communication between the central passageway and the ambient environment external of the body, the ports configured to direct propulsion gases outward therethrough when the firearm is discharged; a second plurality of ports provided on the body and spaced circumferentially about the central axis, the second plurality of ports extending radially from a second point located along the central axis between the first point and a point at which the central axis contacts the distal end of the body, said second plurality of ports open to the central passageway and to an ambient environment external to the body side wall, the second plurality of ports in fluid communication between the central passageway and the ambient environment external of the body, the ports configured to direct propulsion gases outward therethrough when the firearm is discharged; said second plurality of ports spanning a circumferential arc of less than about 270 degrees;

a third plurality of ports provided on the distal end of the body and spaced circumferentially about the central passageway, each of the third plurality of ports extending inward along a longitudinal axis parallel to the central axis and independently bisecting a port of the first plurality of ports, a portion of third plurality of ports also bisecting ports of the second plurality of ports, each one of the third plurality of ports thereby open to the central passageway through one of the first plurality of ports, and wherein a portion of the third plurality of ports each also are open to the central passageway through one of the second plurality of ports to provide fluid communication between the central passageway and an ambient environment external of the body, the third plurality of ports configured to direct propulsion gases outward therethrough when the firearm is discharged; and a slidably adjustable collar positioned about and adjoining the body's cylindrical side wall portion; said collar slidably movable in a distal or proximal direction along the central axis enabling the closure or opening of the radially extending fluid ports of at least one plurality of the first and second pluralities of ports; wherein the second plurality of ports provided on the body includes a upper-side portion and a lower-side portion defined by a horizontally-oriented imaginary plane passing through the central axis of the body, the second plurality of ports being provided on the body such that the upper-side portion is capable of directing a greater volume of propulsion gases therethrough than the lower-side portion when the firearm is discharged.

According to yet another aspect, the present invention provides firearms comprising a firearm barrel and an adjustable muzzle device integrated with the firearm barrel, said muzzle device as described hereinthroughout. In some aspects, the device is permanently integrated with the barrel. In other aspects, the device is capable of reversible attachment to the firearm barrel, or interchange between two firearms.

According to still another aspect, the present invention provides firearms comprising:

a body having a distal end, a proximal end, and a central passageway extending therebetween, the body being mountable to the muzzle end of the firearm barrel such that the central axis is aligned with a barrel axis defined by a bore of the firearm barrel, said body further comprising a cylindrical side wall portion extending proximally from the distal end; and a first plurality of ports provided on the body and spaced circumferentially about the central axis, the first plurality of ports extending radially outward from a first point located along the central axis to the cylindrical side wall portion, open to the central passageway and to an ambient environment external to the body side wall, the plurality of ports in fluid communication between the central passageway and the ambient environment external of the body, the ports configured to direct propulsion gases outward therethrough when the firearm is discharged;

a second plurality of ports provided on the body and spaced circumferentially about the central axis, the second plurality of ports extending radially from a second point located along the central axis between the first point and a point at which the central axis contacts the distal end of the body, said second plurality of ports open to the central passageway and to an ambient environment external to the body side wall, the second plurality of ports in fluid communication between the central passageway and the ambient environment external of the body, the ports configured to direct propulsion gases outward therethrough when the firearm is discharged; said second plurality of ports spanning a circumferential arc of less than about 270 degrees;

a third plurality of ports provided on the distal end of the body and spaced circumferentially about the central passageway, each of the third plurality of ports extending inward along a longitudinal axis parallel to the central axis and independently bisecting a port of the first plurality of ports, a portion of third plurality of ports also bisecting ports of the second plurality of ports, each one of the third plurality of ports thereby open to the central passageway through one of the first plurality of ports, and wherein a portion of the third plurality of ports each also are open to the central passageway through one of the second plurality of ports to provide fluid communication between the central passageway and an ambient environment external of the body, the third plurality of ports configured to direct propulsion gases outward therethrough when the firearm is discharged; and a slidably adjustable collar positioned about and adjoining the body's cylindrical side wall portion; said collar slidably movable in a distal or proximal direction along the central axis enabling the closure or opening of the radially extending fluid ports of at least one plurality of the first and second pluralities of ports;

wherein the second plurality of ports provided on the body includes a upper-side portion and a lower-side portion defined by a horizontally-oriented imaginary plane passing through the central axis of the body, the second plurality of ports being provided on the body such that the upper-side portion is capable of directing a greater volume of propulsion gases therethrough than the lower-side portion when the firearm is discharged.

According to another aspect of the present invention, the adjustable muzzle devices include a generally cylindrical body having: a longitudinal axis; a central bore disposed longitudinally through the body, the body having a proximal end and distal end, wherein the proximal end of the body includes means for attaching the body to a distal end of a gun barrel; a set of longitudinally directed passages distributed at a common radius entirely around the central bore, the longitudinal passages each having open ports at the distal end of the body and each passageway having a common longitudinal depth into the body from the distal end; a first row of radially directed passages disposed entirely around the body, the radially directed passages having ports open to the central bore, the longitudinal passages and to a radial surface of the body; the first row of radially directed passages located along the longitudinal axis at the depth of and passing transversely through the longitudinal passages; wherein the central bore is fluidly connected to an external environment through the first row of radially directed passages, and through the longitudinal passages and a portion of the first row of radially directed passages; a second row of radially directed passages disposed around the body, the second row of radially directed passages having ports open to the central bore, the longitudinal passages and to a radial surface of the body; the second row of radially directed passages located along the longitudinal axis between the first row of radially directed passages and the distal end of the muzzle device, the second row of radially directed passages passing transversely through the longitudinal passages, the second row of radially directed passages spanning from about 90 degrees to about 270 degrees around the body; wherein the central bore is fluidly connected to the external environment through the second row of radially directed passages, and through the longitudinal passages and a portion of the second row of radially directed passages; and an adjustable collar disposed over and around a portion the body's radial surface, the collar having three holes aligned along the longitudinal axis, and a longitudinal slot disposed through the collar opposite the three holes, the longitudinal slot disposed over a set screw disposed within the body surface to prevent the collar from rotating around the longitudinal axis while allowing the collar to be locked in place; where in a spring loaded detent is disposed within an external surface of the body such that the detent seats in one of the three holes through the collar to position the collar in one of three reversibly locked positions: a first position wherein the radial surface ports of the first and second rows are covered by the collar and only the longitudinal passages are open to the external environment, a second position wherein the radial surface ports of the first row are covered by the collar and the second row of passages and the longitudinal passages are open, and a third position wherein the first and second rows of radially directed passages and the longitudinal passages are each open to the external environment.

Advantages of herein disclosed adjustable muzzle devices over existing muzzle devices may include their adjustability to changing operational conditions resulting in higher overall efficiency, while performing so as to reduce impacts due to forces exerted by the weapon's firing as well as reductions in muzzle flash, recoil, or excessive sound, and concussive forces experienced by the shooter, all while keeping a single device attached to or integral with the firearm barrel of a weapon. This also reduces the number of muzzle devices required by the shooter for his firearm as well as simplifies the tools necessary to ready the firearm for conditions presented.

The foregoing and other objectives, features, and advantages of the invention will be more readily understood upon consideration of the following detailed description of the invention.

DETAILED DESCRIPTION

Figure 1:
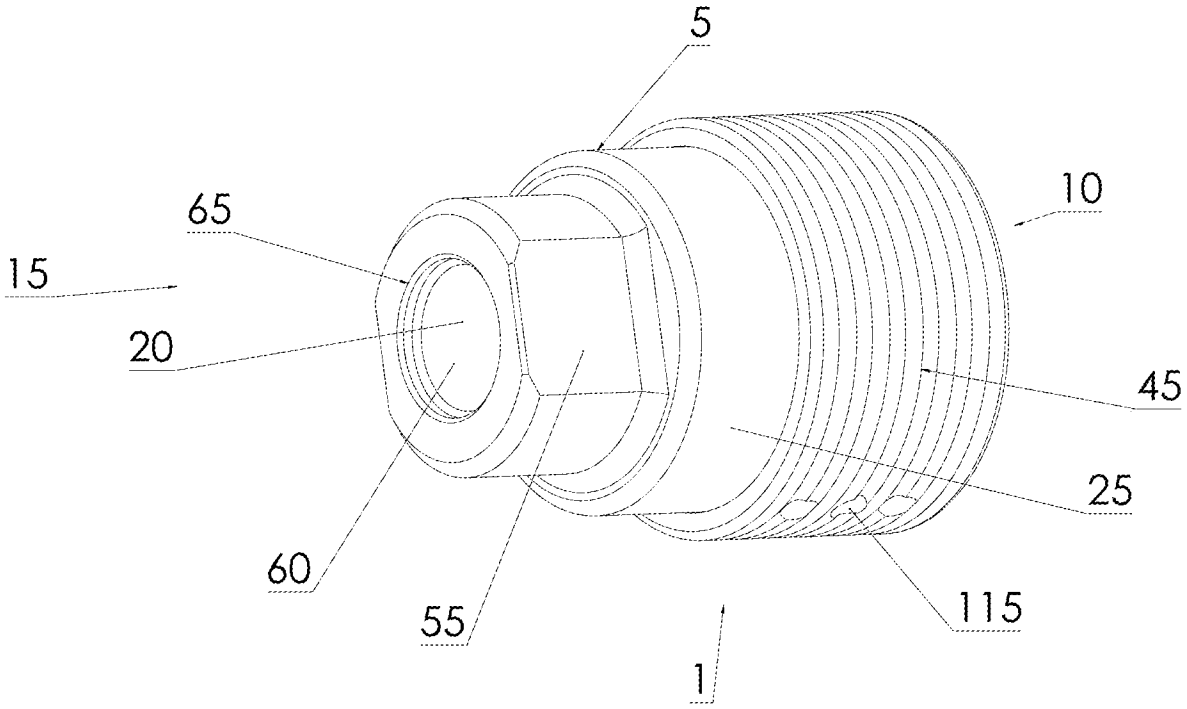
FIG. 1 illustrates a proximal perspective view of an embodiment of an adjustable muzzle device of the present invention.
Figure 2:
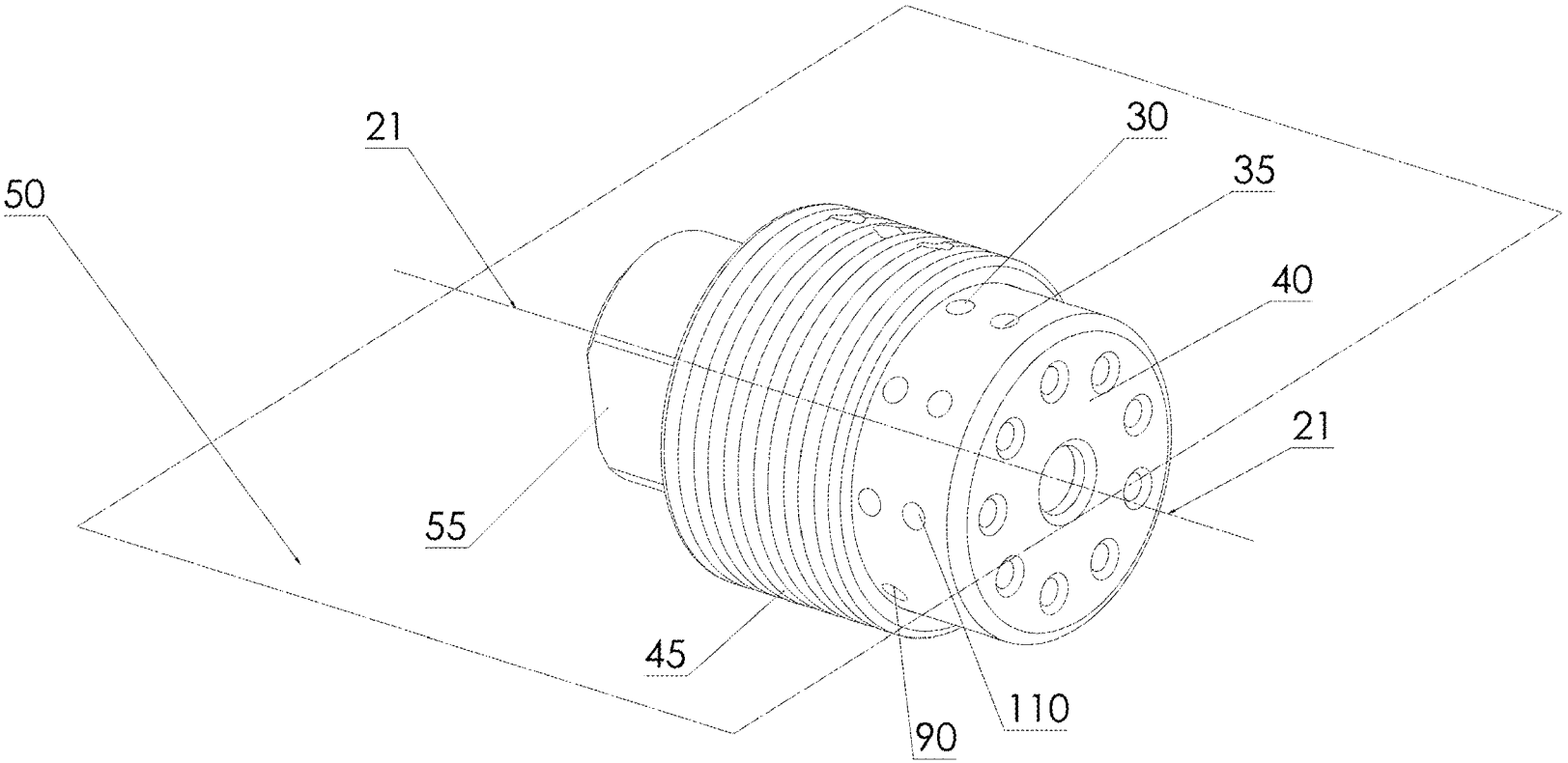
FIG. 2 illustrates a distal perspective view of an embodiment of an adjustable muzzle device of the present invention, wherein the slidable collar is shown in a more proximally located position, exposing the first and second pluralities of ports to the ambient environment external to the body side wall.
Figure 3:
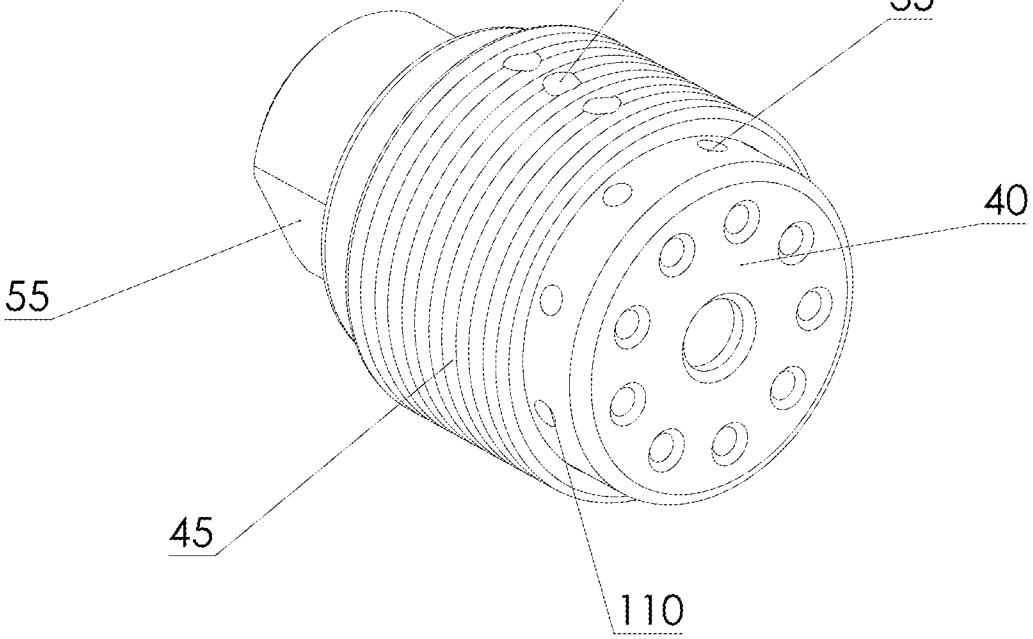
FIG. 3 illustrates a distal perspective view of an embodiment of an adjustable muzzle device of the present invention, wherein the slidable collar is shown in an intermediate position, exposing the second pluralities of ports to the ambient environment external to the body side wall.
Figure 4:
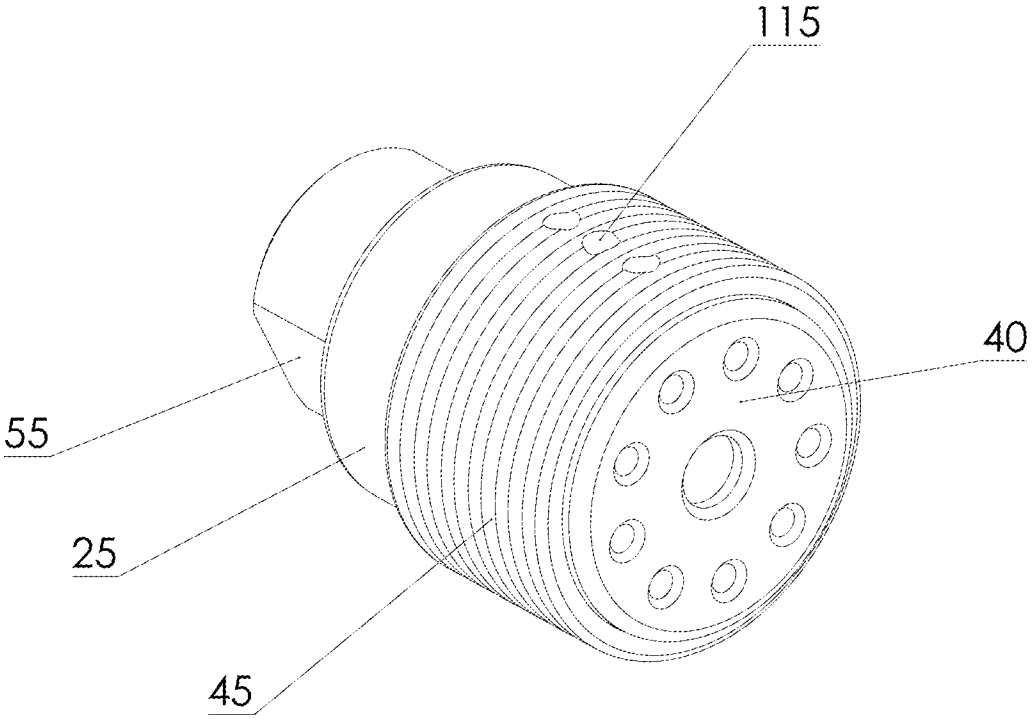
FIG. 4 illustrates a distal perspective view of an embodiment of an adjustable muzzle device of the present invention, wherein the slidable collar is shown in a more distally located position and depicting the three holes in the collar for receiving the detent.
Figure 5:
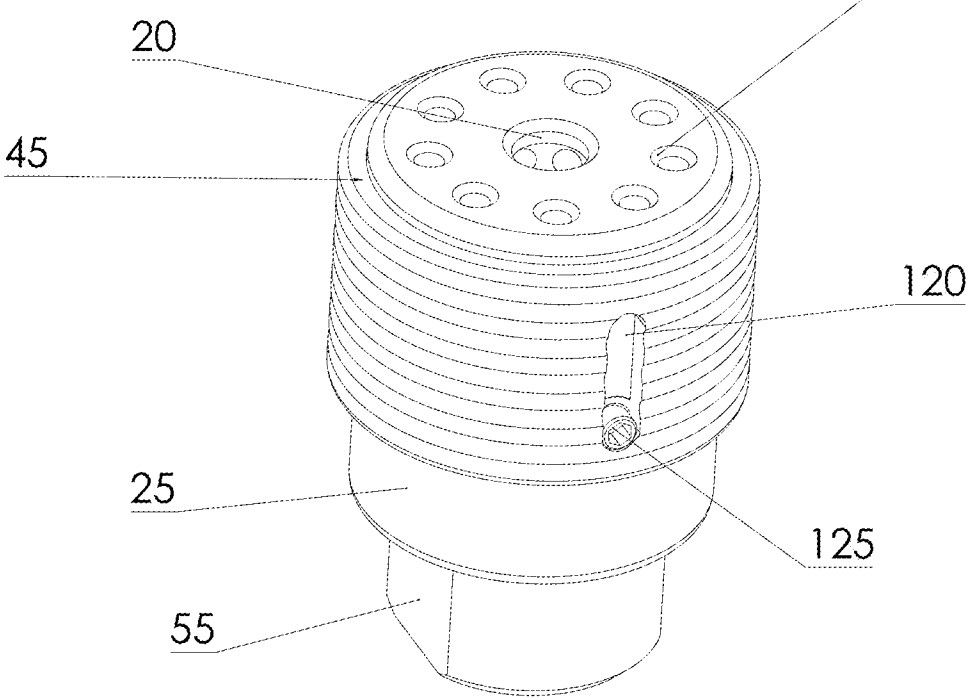
FIG. 5 illustrates a side perspective view of an embodiment of an adjustable muzzle device of the present invention, wherein the slidable collar is shown in a more distally located position and depicting the collar's longitudinal slot and set screw.

The following detailed description and the appended drawings describe and illustrate exemplary embodiments of the invention solely for the purpose of enabling one of ordinary skill in the relevant art to make and use the invention. As such, the detailed description and illustration of these embodiments are purely exemplary in nature and are in no way intended to limit the scope of the invention, or its protection, in any manner. It should also be understood that the drawings may not be to scale and in certain instances details have been omitted, which are not necessary for an understanding of the present invention, such as conventional details of fabrication and assembly.

Definitions

As used herein, the term "proximal" shall mean ends or parts that are closer to the stock of a firearm, in opposite contrast to "distal" ends or points, which are located farther from the firearm stock. Hence, with respect to attachments that extend the barrel of a firearm, the proximal end of the attachment is the end that is located adjacent to and/or integral with the firearm barrel, and the "distal" end of the attachment shall mean its end that extends longitudinally further away from the muzzle end of a firearm barrel in the intended use configuration.

As used herein, the term "port" refers to an opening and/or passageway that allows fluid communication between one point and another in the devices of the present invention. For example, ports of a first plurality include an opening at the cylindrical wall of the central passageway and an opening at the side wall portion of the body, allowing fluid communication between the central passageway and an ambient environment external to the side wall. In bisecting the ports of the third plurality, an additional opening is created which thereby provides a further fluid passageway between the central passageway and the environment external to the distal end of the device. Similarly, ports of a second plurality include an opening at the cylindrical wall of the central passageway and an opening at the side wall portion of the body, allowing fluid communication between the central passageway and an ambient environment external to the side wall. In bisecting the ports of the third plurality, an additional pair of openings is created on opposing inner walls of the ports of the third plurality which thereby provide a further fluid passageway between the central passageway and the environment external to the distal end of the device.

As used herein, the term "port' includes the port opening at an end of a fluid passageway or portion of a fluid passageway and the fluid passageway between any two port openings. Typically, a port extends from a port opening at the central passageway to a port opening at the cylindrical side wall portion or to the distal end of the body. A port may also be considered to extend from a port opening at the distal end of the body passageway to a port opening at the bisection of a longitudinally directed passage with a port of either of the first or second plurality of ports.

PARTS LIST

1 adjustable muzzle device
5 Body
10 distal end of body
15 proximal end of body
20 central passageway or central bore
21 central axis
25 cylindrical side wall portion of body
30 one of first plurality of ports
35 one of second plurality of ports
40 one of third plurality of ports
45 adjustable collar
50 horizontally oriented imaginary plane
55 parallel flats
60 cylindrical wall defining central passageway
65 threads
70 longitudinally directed passages
75 first row of radially directed passages
80 port openings associated with first row of radially directed passages that are open to the central bore
85 port openings associated with first row of radially directed passages that are open to the longitudinal passages
90 port openings associated with first row of radially directed passages that are open to a radial surface of the body
95 second row of radially directed passages
100 port openings associated with second row of radially directed passages that are open to the central bore
105 port openings associated with second row of radially directed passages that are open to the longitudinal passages
110 port openings associated with second row of radially directed passages that are open to a radial surface of the body
115 holes in the adjustable collar
120 longitudinal slot
125 set screw
130 groove
135 O-ring In certain embodiments of the present invention, adjustable muzzle devices are provided that employ a slidable collar positioned around the body of the device to interconvert between a muzzle device having flash suppression properties and one having recoil reduction properties or the capability to lessen unwanted movement of the barrel by helping to stabilize the muzzle while firing.

In other embodiments of the present invention, adjustable muzzle devices are provided that employ a slidable collar positioned around the body of the device to interconvert between a muzzle device having flash suppression properties and one having noise level and associated concussive force reduction properties.

In certain embodiments of the present invention, adjustable muzzle devices are provided that employ a slidable collar positioned around the body of the device to interconvert between a muzzle device having having noise level and associated concussive force reduction properties and one having recoil reduction properties or the capability to lessen unwanted movement of the barrel by helping to stabilize the muzzle while firing.

In certain embodiments of the present invention, adjustable muzzle devices are provided that employ a slidable or otherwise adjustable collar positioned around the body of the device to interconvert between muzzle device positions that provide noise level and associated concussive force reduction properties, recoil reduction properties or the capability to lessen unwanted movement of the barrel by helping to stabilize the muzzle while firing, and flash supression.

In certain other embodiments, a groove is provided in the cylindrical sidewall portion of the device's body circumferentially located about the central axis. The groove is compatible with an O-ring appropriately sized to accept the O-ring. Preferably, the groove is located between the distal end of the device and the set screw associated with the adjustable collar. When the adjustable collar is moved distally to cover the first and second pluralities of ports, O-ring forms a seal with an inside surface of the adjustable collar to substantially reduce or prevent blowback of exhaust gases toward the shooter during the weapon's firing.

Exemplary Embodiments

Referring to the drawings, FIGS. 1 to 8 depict an illustrative embodiment of an adjustable muzzle device according to the present invention. Adjustable muzzle device 1 is provided with a body 5 having a distal end 10 and a proximal end 15 and a central passageway (or central bore) 20 extending between the distal and proximal ends. The central passageway is defined by a central axis 21 that extends longitudinally from the body's distal to proximal end, and aligns with a barrel axis defined by the bore of a firearm barrel. In certain embodiments, a portion of a cylindrical wall 60 defining the central passageway at the proximal end of the device includes means for attaching the muzzle device to the firearm barrel distal end. In some embodiments, the cylindrical wall 60 defining the central passageway at the proximal end of the device is threaded 65 for attaching to a firearm barrel.

The body of the muzzle device includes a cylindrical sidewall portion 25 that extends proximally from the distal end. In some embodiments, the cylindrical side wall portion includes parallel flats 55, preferably located proximally to the proximal end of the muzzle device. The body 5 further includes three pluralities of ports and a slidably adjustable collar.

The first of the three pluralities of ports 30 provided on the body are spaced about the central axis 21 in circumferential fashion and extend radially outward from the central axis.

The ports 30 are open to both the central passageway 20 and to the cylindrical side wall portion 25 and provide fluid communication between the central passageway 20 and an ambient environment external to the body side wall. These first ports are configured to direct propulsion gases outward and through the ports to the external environment when the firearm is discharged. In some embodiments, the first plurality of ports are substantially perpendicular to the central axis.

The second of the three pluralities of ports 35 provided on the body are spaced about the central axis in circumferential fashion and extend radially outward from the central axis. In certain embodiments, the second plurality of ports spans a circumferential arc of less than about 270 degrees, preferably between about 90 and about 270 degrees, and all combinations and subcombinations of ranges therebetween. The second plurality of ports 35 are located along the central axis 21 at a point between the point where the first ports extend from the central axis and a point at which the central axis contacts the distal end of the body. The ports 35 are open to both the central passageway 20 and to the cylindrical side wall portion 25 and provide fluid communication between the central passageway 20 and an ambient environment external to the body side wall. These second ports are configured to direct propulsion gases outward and through the ports to the external environment when the firearm is discharged. In some embodiments, the second plurality of ports are substantially perpendicular to the central axis.

The third of the three pluralities of ports 40 provided on the distal end of the body are spaced circumferentially about the central passageway, preferably at a common radius. Each of the third plurality of ports extends inward from the distal end of the body along a longitudinal axis parallel to the central axis. Each third port independently bisects a port of each of the first plurality of ports, such that each of the third ports is in fluid communication with a first port, and thus, indirectly, with both the central passageway 20 and with the ambient environment external to the body side wall. Dependent on the number of second ports 35, a portion of the third ports will also each independently bisect a port of the second plurality of ports, such that each of the portion of third ports is in fluid communication with a second port, and thus, indirectly, with both the central passageway 20 and with the ambient environment external to the body side wall. The third plurality of ports 40 are open to both the central passageway 20 (via 30 and/or 35) and to the distal end of the body 10 and provide fluid communication between the central passageway 20 and an ambient environment external of the body along the cylindrical side wall portion 25 of the body and/or the distal end 10 of the body 5, depending on the position of the slidably adjustable collar along the body. These third ports are configured to direct propulsion gases outward and through the third ports to the external environment at the distal end of the body when the firearm is discharged.

The slidably adjustable collar 45 fits around the body's cylindrical side wall portion 25 and may be moved in proximal or distal direction along the central axis. The range of collar movement allows a portion of the collar to cover over the first plurality of ports (see FIG. 7), or both the first and second pluralities of ports (see FIG. 8), in addition to a location along the central axis wherein both first and second pluralities of ports are open to the external environment (see FIG. 2). This range of movement of the collar permits the device user to select from between three positions for the exhausting of firing gases from the central passageway to the external environment. When the collar is slid to its most distal position, the collar creates a closure of the fluid passageways that include the cylindrical side wall portion's first and second pluralities of ports (75 and 95, respectively). This closure of those fluid passageways results in the exit gases from the central passageway being directed distally to the external environment through the fluid passageways 70 that are in part defined by the third pluralities of ports. When the collar is positioned at its most proximal position, the cylindrical side wall portion's first and second pluralities of ports are fully exposed to the external environment leading to an opening of those fluid passageways. In this situation, the fluid passageways for the exhaust gases to the external environment result in the exit gases from the central passageway being directed through a combination of the pluralities of ports to the front and sides of the firearm as well as above and below the device. When the collar is positioned at a point along the axis intermediate between the most distal and the most proximal positions, the cylindrical side wall portion's first plurality of ports are covered (resulting in a closure of that fluid passageway, while the fluid passageway defined by the second plurality of ports is fully open to the external environment. This intermediate positioning of the collar results in the exit gases from the central passageway being at least primarily directed to the front (third plurality of ports), top and sides (second plurality of ports) of the device. At this positioning, lesser amounts of gases may still be directed downward of the firearm, when the second plurality of ports spans a circumferential arc of greater than about 180 degrees, or alternatively, when the second plurality of ports provided on the body includes a upper-side portion and a lower-side portion defined by a horizontally-oriented imaginary plane 50 passing through the central axis of the body, the second plurality of ports being provided on the body such that the upper-side portion directs a greater volume of propulsion gases therethrough than the lower-side portion when the firearm is discharged.

Figure 6:
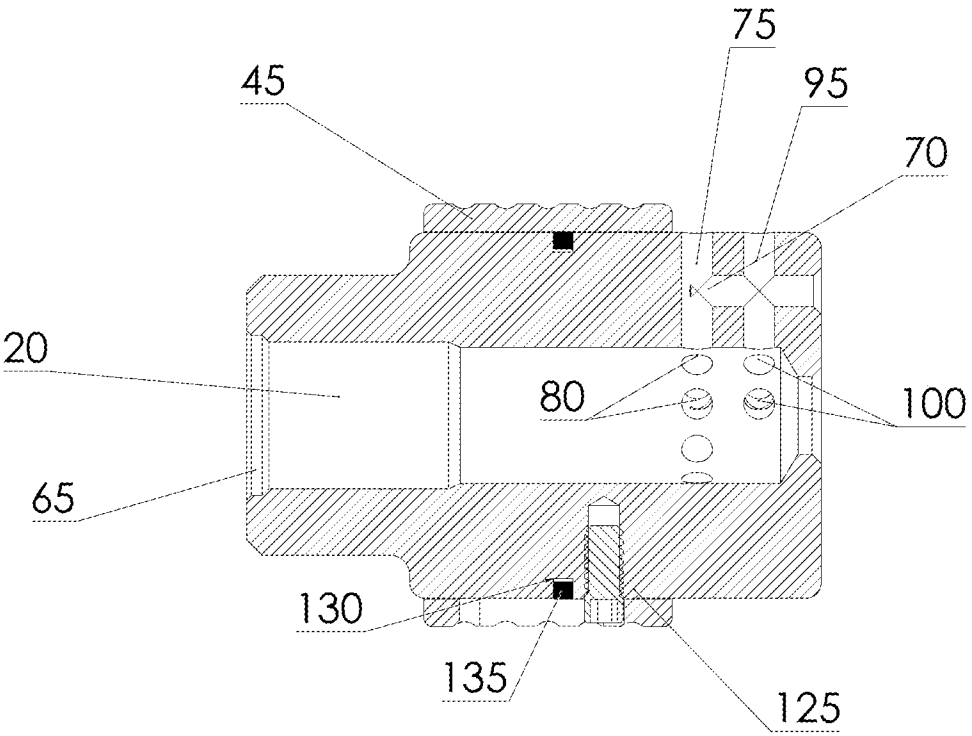
FIG. 6 illustrates a cross-sectional side view of an embodiment of an adjustable muzzle device of the present invention, wherein the slidable collar is shown in a more proximally located position and depicting the fluid communication between the central passageway and the ambient environment external to the body side wall via the first and second pluralities of ports.
Figure 7:
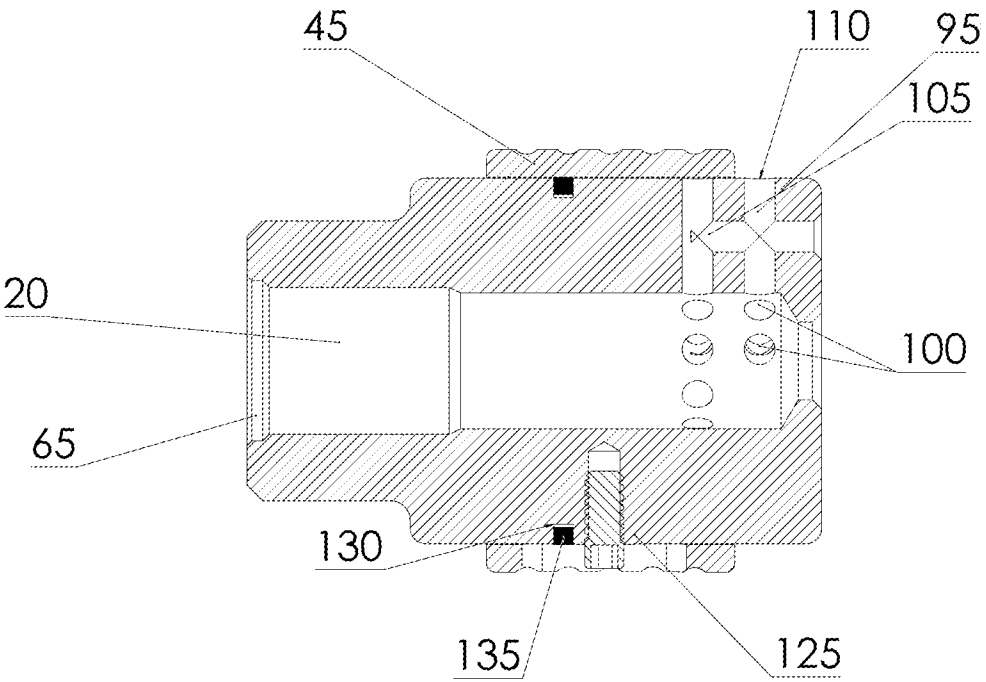
FIG. 7 illustrates a cross-sectional side view of an embodiment of an adjustable muzzle device of the present invention, wherein the slidable collar is shown in an intermediate position and depicting the fluid communication between the central passageway and the ambient environment external to the body side wall via the second pluralities of ports.
Figure 8:
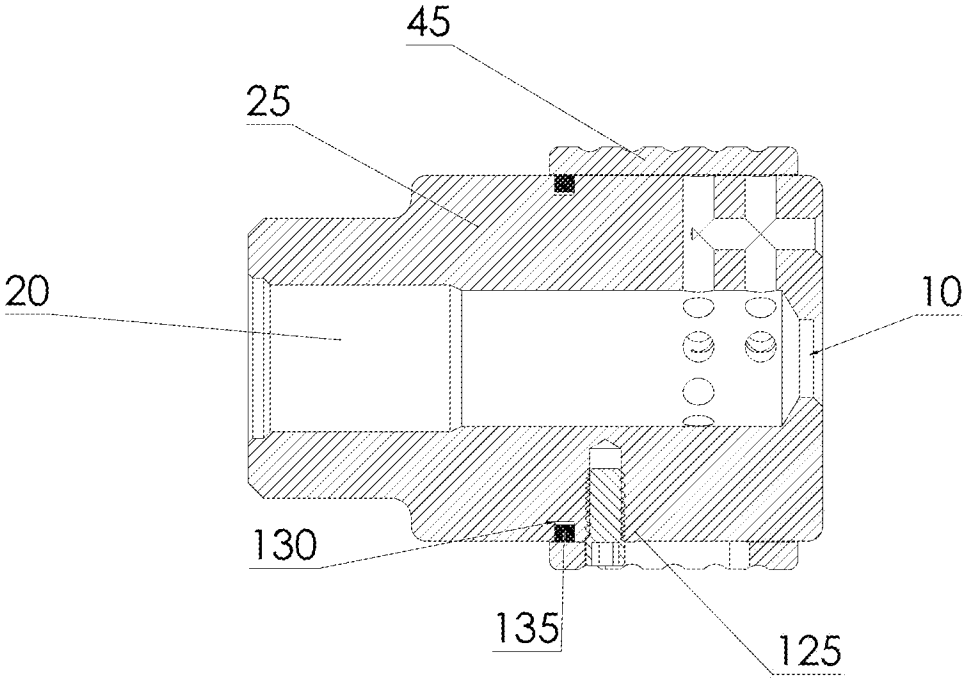
FIG. 8 illustrates a cross-sectional side view of an embodiment of an adjustable muzzle device of the present invention, wherein the slidable collar is shown in a more distally located position and depicting the closure of fluid communication between the central passageway and the ambient environment external to the body side wall via the first and second pluralities of ports.

A groove 130 is provided in the cylindrical sidewall portion of the body 5 circumferentially about the central axis (FIG. 6). The groove is compatible with O-ring 135 and is appropriately sized to accept the O-ring and form a seal with the adjustable collar when the adjustable collar is moved to its forward position. Preferably, the groove is located such that the groove is between the distal end of the device and set screw 125. Preferably, the O-ring is made of metal such as cast iron or steel. In some embodiments, the O-ring or piston ring is cast iron. In other embodiments, the dimensions of the O-ring are approximately 30 mm by 1.5 mm. When adjustable collar 45 is moved distally to cover the first and second pluralities of ports, O-ring 135 forms a seal with an inside surface of the adjustable collar to substantially reduce or prevent blowback of exhaust gases toward the shooter when the weapon is fired.

As earlier disclosed, certain of the adjustable muzzle devices of the present invention may be irreversibly attached to the distal end of a firearm barrel. Because the collars on such devices are capable of slidable movement along the device's central axis while the device is fixed to the firearm, these devices maintain their adjustability for use in differing firearm use situations. Other adjustable muzzle devices of the present invention may be reversibly attached to the distal end of a firearm barrel by any known means, such as for example, compatible threading of the barrel and muzzle device. This reversible attaching allows the user to quickly install or uninstall the device on the fly, if desired. Typically, the device may be left attached to take advantage of the device's multiple operating positions. Once the device is installed or fixed to the firearm barrel, the user elects one of the device's operating positions based upon his analysis of the conditions under which the firearm is to be fired. Using, for example, a spring loaded detent on the device's body matable with a series of longitudinally provided holes on the collar and applying slight pressure in a distal or proximal direction, the user can shift the location of the adjustable collar from one position to another. The positions correlate as to whether or not none, one or both of the first and second pluralities of ports is open to the external environment.

For example, a user may wish to fire the firearm in a situation where the priority is to reduce firing noise and concomitant firing concussion. By moving the collar distally so as to close the first and second pluralities of ports, the muzzle device will direct firing gases away from the user and in the direction of the target, and will generally act as a linear compensator at this setting. Once the adjustable collar is in position, the set screw may be tightened in the device's provided slot. The longitudinal slot and set screw not only are capable of reversibly locking the collar in place longitudinally, but also provide resistance to longitudinal twisting of the collar as a function of forces imposed by the weapon's firing.

Alternatively, a user may require the firearm's recoil characteristics or firing forces, such as muzzle rise, to be reduced to improve shooting accuracy. This can be accomplished by selecting an intermediate position on the device. While firing with the device in this position does direct some gases toward the target, it also directs certain amounts of gases to the sides and above the firearm via the second plurality of ports. The latter gases are directed substantially perpendicular to the central axis, which thereby redirects some of the force typically experienced during weapon recoil, as well as exerting an opposing force to counteract muzzle rise. Moreover, this setting also the added advantage of reducing the exposure of others in close quarters to the hot gases and/or flash because the amounts of gases redirected in a downward direction are limited relative to those gases directed in upward and sidewise fashion.

Whenever high levels of shooting accuracy are needed, such as in target competitions, maximum reduction of recoil and related forces becomes tantamount. By adjusting the present device to a position where both first and second pluralities of ports are open to the external environment, maximum disbursement of firing gases is achieved. The force of exhaust gases directed substantially perpendicular to the bullet's firing vector via the first and second pluralities of ports in the device reduces the amounts of gases exiting forward, thereby further minimizing recoil, and creates a stabilizing counterforce to other lateral forces caused by the physics of firing. This positioning of the collar also holds the greatest advantage for reducing the visible signature of expanding gases at night as well as further minimizing the potential for temporary night blindness caused by any flash.

Previous devices were generally designed to function only in one of these types of situations. Operators would necessarily need to carry multiple devices in the field as well as the tools associated with their attachment and removal. Each prior art device interchange takes precious time to complete, and in critical situations, there may not be time available to make a tactical change to a weapon, leading to increased risk for the shooter, or less optimal use of the firearm. In contrast, the present muzzle devices are provided that minimize the number of devices and tools necessary to be carried in the field, allow quick changes to firearm operation without removal of the devices from weapons, and may further reduce risk or optimize use of the firearm while readily adjusting the firearms to suit the needs of the shooter in a range of firing situations.

Any other undisclosed or incidental details of the construction or composition of the various elements of the disclosed embodiments of the present invention are not believed to be critical to the achievement of the advantages of the present invention, so long as the elements possess the attributes needed for them to perform as disclosed. Certainly, one of ordinary skill in the hydro-mechanical arts would be able to conceive of a wide variety of device shapes and sizes and successful combinations of the invention disclosed herein. The selection of these and other details of construction are believed to be well within the ability of one of even rudimentary skills in this area, in view of the present disclosures.

Illustrative embodiments of the present invention have been described in considerable detail for the purpose of disclosing the practical, operative structure whereby the invention may be practiced advantageously. The designs described herein are intended to be exemplary only. The novel characteristics and features of the present invention may be incorporated in other structural forms without departing from the spirit and scope of the present invention. The invention encompasses embodiments both comprising and consisting of the elements described with reference to the illustrative embodiments. The invention illustratively disclosed herein suitably may be practiced in the absence of any element which is not specifically disclosed herein. The invention illustratively disclosed herein suitably may also be practiced in the absence of any element which is not specifically disclosed herein and that does not materially affect the basic and novel characteristics of the claimed invention.

Unless otherwise indicated, all ordinary words and terms used herein shall take their customary meaning as defined in The American Heritage Dictionary, Third Edition. All technical terms shall take on their ordinary and customary meaning as established by the appropriate technical discipline utilized in that particular art.

The invention illustratively disclosed herein suitably may be practiced in the absence of any element which is not specifically disclosed herein. The invention illustratively disclosed herein suitably may also be practiced in the absence of any element which is not specifically disclosed herein and that does not materially affect the basic and novel characteristics of the claimed invention.

What is claimed:

1. A muzzle device for use with a muzzle end of a firearm barrel, the muzzle device comprising:

a body having a distal end, a proximal end, and a central passageway extending therebetween, the body being mountable to the muzzle end of the firearm barrel such that the central axis is aligned with a barrel axis defined by a bore of the firearm barrel, said body further comprising a cylindrical side wall portion extending proximally from the distal end; and a first plurality of ports provided on the body and spaced circumferentially about the central axis, the first plurality of ports extending radially outward from a first point located along the central axis to the cylindrical side wall portion, open to the central passageway and to an ambient environment external to the body side wall, the plurality of ports in fluid communication between the central passageway and the ambient environment external of the body, the ports configured to direct propulsion gases outward therethrough when the firearm is discharged;

a second plurality of ports provided on the body and spaced circumferentially about the central axis, the second plurality of ports extending radially from a second point located along the central axis between the first point and a point at which the central axis contacts the distal end of the body, said second plurality of ports open to the central passageway and to an ambient environment external to the body side wall, the second plurality of ports in fluid communication between the central passageway and the ambient environment external of the body, the ports configured to direct propulsion gases outward therethrough when the firearm is discharged; said second plurality of ports spanning a circumferential arc of less than about 270 degrees;

a third plurality of ports provided on the distal end of the body and spaced circumferentially about the central passageway, each of the third plurality of ports extending inward along a longitudinal axis parallel to the central axis and independently bisecting a port of the first plurality of ports, a portion of third plurality of ports also bisecting ports of the second plurality of ports, each one of the third plurality of ports thereby open to the central passageway through one of the first plurality of ports, and wherein a portion of the third plurality of ports each also are open to the central passageway through one of the second plurality of ports to provide fluid communication between the central passageway and an ambient environment external of the body, the third plurality of ports configured to direct propulsion gases outward therethrough when the firearm is discharged; and a slidably adjustable collar positioned about and adjoining the body's cylindrical side wall portion; said collar slidably movable in a distal or proximal direction along the central axis enabling the closure or opening of the radially extending fluid ports of at least one plurality of the first and second pluralities of ports;

wherein the second plurality of ports provided on the body includes a upper-side portion and a lower-side portion defined by a horizontally-oriented imaginary plane passing through the central axis of the body, the second plurality of ports being provided on the body such that the upper-side portion is capable of directing a greater volume of propulsion gases therethrough than the lower-side portion when the firearm is discharged.

2. A firearm comprising a firearm barrel and a muzzle device of claim 1.

3. A muzzle device of claim 1, wherein the first plurality of ports are substantially perpendicular to the central axis.

4. A muzzle device of claim 1, wherein the second plurality of ports are substantially perpendicular to the central axis.

5. A muzzle device of claim 3, wherein the second plurality of ports are substantially perpendicular to the central axis.

6. A muzzle device of claim 1, wherein the second plurality of ports spans a circumferential arc of between about 90 and about 270 degrees.

7. A muzzle device of claim 5, wherein the second plurality of ports spans a circumferential arc of between about 90 and about 270 degrees.

8. A muzzle device of claim 1, wherein the side wall portion further comprises parallel flats located proximal to the proximal end of the device.

9. A muzzle device of claim 6, wherein the side wall portion further comprises parallel flats located proximal to the proximal end of the device.

10. A muzzle device of claim 7, wherein the side wall portion further comprises parallel flats located proximal to the proximal end of the device.

11. A muzzle device of claim 1, wherein a portion of a cylindrical wall defining the central passageway at the proximal end of the device is threaded for attaching to a firearm barrel.

12. A muzzle device of claim 1, wherein a spring loaded detent is disposed within the body surface.

13. A muzzle device of claim 12, wherein the adjustable collar includes three longitudinally aligned holes suitable for interchangeably mating with the spring loaded detent.

14. A muzzle device of claim 1, wherein the adjustable collar includes a longitudinal slot disposed through the collar.

15. A muzzle device of claim 14, wherein the longitudinal slot is disposed around a set screw suitable to minimize collar rotation about the longitudinal axis of said muzzle device.

16. A muzzle device of claim 15, wherein the set screw is suitable for reversibly locking and unlocking the adjustable collar in one of a plurality of slidably adjustable positions of the collar.

17. A firearm comprising a firearm barrel and an integrated muzzle device, wherein the muzzle device comprises:

a body having a distal end, a proximal end, and a central passageway extending therebetween, the body being mountable to the muzzle end of the firearm barrel such that the central axis is aligned with a barrel axis defined by a bore of the firearm barrel, said body further comprising a cylindrical side wall portion extending proximally from the distal end; and a first plurality of ports provided on the body and spaced circumferentially about the central axis, the first plurality of ports extending radially outward from a first point located along the central axis to the cylindrical side wall portion, open to the central passageway and to an ambient environment external to the body side wall, the plurality of ports in fluid communication between the central passageway and the ambient environment external of the body, the ports configured to direct propulsion gases outward therethrough when the firearm is discharged;

a second plurality of ports provided on the body and spaced circumferentially about the central axis, the second plurality of ports extending radially from a second point located along the central axis between the first point and a point at which the central axis contacts the distal end of the body, said second plurality of ports open to the central passageway and to an ambient environment external to the body side wall, the second plurality of ports in fluid communication between the central passageway and the ambient environment external of the body, the ports configured to direct propulsion gases outward therethrough when the firearm is discharged; said second plurality of ports spanning a circumferential arc of less than about 270 degrees;

a third plurality of ports provided on the distal end of the body and spaced circumferentially about the central passageway, each of the third plurality of ports extending inward along a longitudinal axis parallel to the central axis and independently bisecting a port of the first plurality of ports, a portion of third plurality of ports also bisecting ports of the second plurality of ports, each one of the third plurality of ports thereby open to the central passageway through one of the first plurality of ports, and wherein a portion of the third plurality of ports each also are open to the central passageway through one of the second plurality of ports to provide fluid communication between the central passageway and an ambient environment external of the body, the third plurality of ports configured to direct propulsion gases outward therethrough when the firearm is discharged; and a slidably adjustable collar positioned about and adjoining the body's cylindrical side wall portion; said collar slidably movable in a distal or proximal direction along the central axis enabling the closure or opening of the radially extending fluid ports of at least one plurality of the first and second pluralities of ports;

wherein the second plurality of ports provided on the body includes a upper-side portion and a lower-side portion defined by a horizontally-oriented imaginary plane passing through the central axis of the body, the second plurality of ports being provided on the body such that the upper-side portion is capable of directing a greater volume of propulsion gases therethrough than the lower-side portion when the firearm is discharged.

* * * * *